US011635052B1

(12) United States Patent
DiPasquale, Jr.

(10) Patent No.: US 11,635,052 B1
(45) Date of Patent: Apr. 25, 2023

(54) ELECTRO-PNEUMATIC STARTER AND ENGINE STARTING SYSTEM METHODOLOGY

(71) Applicant: Agnes I.P. Holdings, LLC, Waller, TX (US)

(72) Inventor: Charles DiPasquale, Jr., Pittsburgh, PA (US)

( * ) Notice: Subject to any disclaimer, the term of this patent is extended or adjusted under 35 U.S.C. 154(b) by 0 days.

(21) Appl. No.: 17/823,997

(22) Filed: Sep. 1, 2022

(51) Int. Cl.
*F02N 11/00* (2006.01)
*F02N 19/00* (2010.01)
*F02N 7/10* (2006.01)

(52) U.S. Cl.
CPC ..... *F02N 11/00* (2013.01); *F02N 19/001* (2013.01); *F02N 7/10* (2013.01)

(58) Field of Classification Search
CPC ..... F02N 7/00; F02N 7/10; F02N 11/00
USPC ..... 123/179.25
See application file for complete search history.

(56) References Cited

U.S. PATENT DOCUMENTS 3,171,283 A * 3/1965 Giometti ..... F02N 15/026 192/104 C
2015/0107263 A1* 4/2015 Broman ..... F16K 31/5284 60/788
2021/0054837 A1* 2/2021 Robbins ..... F04B 49/10

* cited by examiner

*Primary Examiner* — Phutthiwat Wongwian
*Assistant Examiner* — Arnold Castro
(74) *Attorney, Agent, or Firm* — Dinsmore & Shohl LLP; Monika L. Jaensson, Esq.

(57) ABSTRACT

An electro-pneumatic starter for use with a natural gas powered, reciprocating internal combustion engine in oil and gas industrial applications, and a method of starting an internal combustion engine, are provided. A novel combination of an electric motor and a pneumatically actuated transmission are provided for the innovation as claimed, wherein power is translated from an output shaft and motor gear, through a transmission gear and transmission shaft, and to an output gear mated with a ring gear of a host engine, the transmission shaft being extendable by means of a pneumatically controlled piston. When the transmission shaft is extended it is in the engaged position, capable of providing torque to the ring gear of the host engine; when retracted, the same is disengaged from the host engine.

14 Claims, 3 Drawing Sheets

ELECTRO-PNEUMATIC STARTER AND ENGINE STARTING SYSTEM METHODOLOGY

FIELD OF THE INVENTION

The disclosed technology regards an electro-pneumatic starter motor for industrial internal combustion reciprocating engines in oil and gas industrial applications, and associated methods of starting such engines.

BACKGROUND OF THE INVENTION

In oil and gas industrial applications, natural gas powered, reciprocating, internal combustion engines are used to provide motive power for a variety of machine-driven tasks and applications. Presently, these engines are coupled most commonly with turbine motor driven starters, by using compressed natural gas, and accounting for over a billion cubic feet of raw methane emissions annually in North America. Further, it is well known that raw methane emissions have a more significant impact on the environment and the earth's ozone layer than $CO_2$. However, the sole known alternative available to the industry are electric starters, which are low in power output, large and heavy.

Further, current starters available for natural gas powered, reciprocating, internal combustion engines are typically sized for cost effectiveness to provide the minimum power necessary to rotate and accelerate the engine and mechanical (mass) of an un-coupled and unburdened system. Therefore, the system parasitic load must be removed before starting the engine. Removal of this parasitic load is typically accomplished using a technique called blow down (also used and necessary in emergency shut down situations), wherein large quantities of raw natural gas (methane) stored under pressure at compressor stations are simply released into the environment.

Therefore, there is a need for an ecofriendly, light weight, compact and cost efficient starter for natural gas driven and similarly powered engines used in the oil and gas industries, providing sufficient power to start a combustion engine even when under load.

The disclosed technology provides a novel, high power, ecofriendly, light weight, compact and cost efficient drive starter using electro-pneumatic design with digital control, useful to start natural gas fueled, internal combustion, reciprocating engines. The disclosed technology further provides a novel means for starting gas powered, internal combustion reciprocating engines using an electro-pneumatic starter. By means of the disclosed technology and methods herein described, raw methane fugitive emissions produced by traditional gas driven engine starters and starting methodologies are eliminated. The disclosed technology further reduces or eliminates emissions resulting from system blowdown to remove raw methane gas pressure (load) from the compressor cylinders.

BRIEF SUMMARY OF INVENTION

Generally, the disclosed technology combines an electric starter motor coupled with a pneumatically actuated transmission using pressurized gas, the transmission being engaged and disengaged with a starter ring gear of a host engine, which in combination drive motive power to the host engine through the starter motor's pinion gear when engaged.

More specifically, the present technology includes an electro-pneumatic starter for use with a natural gas powered, reciprocating internal combustion engine in oil and gas industrial applications. The starter includes a brushless, digital electric motor capable of producing at least 25 horsepower and preferably up to at least 10,000 revolutions per minute, the motor having an output shaft which drives a motor spur gear.

Coupled with the electric motor is a pneumatically actuated transmission. The pneumatically actuated transmission includes a transmission input shaft affixed to a torque limiter in mating engagement with a receiving spur gear, which is itself in mating engagement with the motor spur gear such that in operation rotation of the output shaft by the electric motor translates into rotation of the motor spur gear, which drives the receiving gear and the transmission input shaft, subject to limitations of torque as imposed by the torque limiter. The pneumatically actuated transmission further includes a transmission output shaft extendably coupled at one end with the transmission input shaft such that rotation of the input shaft is directly translated to rotation of the transmission output shaft. An output gear capable of mating engagement with the ring gear of the engine is affixed to the other end of the transmission output shaft. The transmission input shaft and the transmission output shaft may be coupled together by means of clutch, such as a one-way, dentil-type clutch, such that the engine ring gear does not transmit torque back through the transmission output shaft to the transmission input shaft.

A transmission housing is provided to support a spring-loaded piston, which is coupled with the transmission output shaft (by means of, for example, the clutch being affixed to or otherwise in moving engagement with the piston) such that movement of the piston within the transmission housing translates directly into extension or retraction of the transmission output shaft and the affixed output gear relative to the transmission input shaft. The transmission housing further includes an entry port which receives pressurized gas from a pneumatic solenoid valve, forcing the piston to move within the transmission housing, exposing an exit port of the transmission housing from which the pressurized gas exits the transmission housing. A pressure sensor is provided which senses the presence or absence of pressurized air at or from the exit port, and upon sensing the presence of pressurized air sends a signal to an electric motor controller to start the electric motor; similarly, when the pressure sensor senses the absence of pressurized air at or from the exit port, it sends a signal to an electric motor controller to stop the electric motor.

The disclosed technology further provides for a method for starting a natural gas powered, reciprocating internal combustion engine, by providing and actuating a starter which includes an electric motor and a pneumatically actuated transmission. The electric motor has an output shaft secured within the bore of a motor gear. In direct or indirect mating engagement with the motor gear is a receiving gear of a pneumatically actuated transmission. The pneumatically actuated transmission further includes a transmission housing, a piston, an extendable transmission shaft, and an output gear.

Specifically, the extendable transmission shaft is coupled with the piston housed in the transmission housing, and is coupled at one end with the receiving gear and affixed at the other end to the output gear, the output gear being available for mating engagement with a starter ring gear of the host engine. As hereinabove described, the receiving gear is mated with the motor gear such that torque from the receiving gear (provided by rotation of the output shaft of the electric motor) is transferred to the extendable transmission shaft and the output gear. A torque limiter may be provided as the coupling of the receiving gear and the extendable transmission shaft to control and limit the torque imposed upon the extendable transmission shaft; likewise, a clutch, such as a one-way, lentil type clutch, may be provided as the coupling of the input and output shafts and the coupling of the piston and the transmission output shaft, so that the engine ring gear does not transmit torque back through the transmission output shaft to the transmission input shaft.

In this configuration, the transmission housing includes an entry port which receives pressurized gas from a pneumatic solenoid valve, forcing the piston into an engaged position, thereby translating a transmission output shaft of the extendable transmission shaft and the output gear into mating engagement with the starter ring gear of the host engine, wherein the pressurized gas exits out of the transmission housing through an exit port. A pressure sensor is provided to sense pressurized gas flowing from the exit port.

Once pressurized gas from the exit port is sensed by the pressure sensor, a signal is sent by the sensor to the electric motor to produce rotation on the output shaft and the motor gear, transmitting torque through the receiving gear and the extendable transmission shaft to the output gear, and thereby generating rotation of the starter ring of the host engine.

Once the host engine reaches a certain pre-determined RPM sufficient to facilitate internal combustion and complete its start and run cycle, the pressurized gas is shut off, and the spring causes the piston to return to the disengaged position, translating with it the output shaft of the extendable transmission shaft and the output gear disengages from the starter ring of the host engine. Sensing no pressurized gas at or from the exit port, the pressure sensor sends a signal to the electric motor to cease operation.

DESCRIPTION OF THE DRAWINGS

The accompanying drawings incorporated in and forming a part of the specifications herein, illustrate the basic elements of the present invention and, together with descriptions cited here, explain the principles of the invention and its operation. In the drawings.

DETAILED DESCRIPTION

Figure 1:
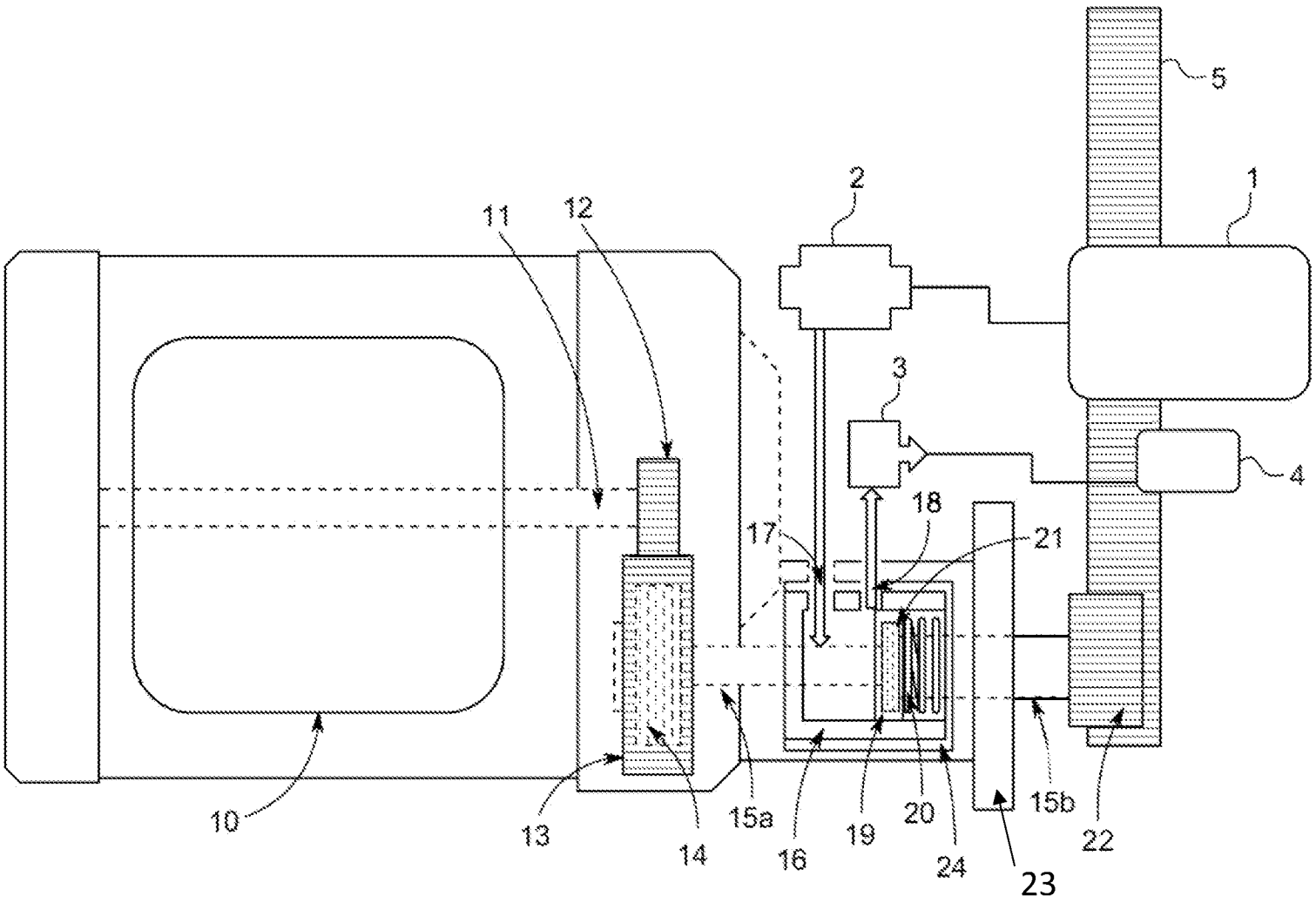
FIG. 1 shows an embodiment of the disclosed technology in the engaged position.

As hereinabove generally described, and described through embodiments in this detailed description and the accompanying drawings, the system of the disclosed technology includes an electric starter motor 10 coupled with a pneumatically actuated transmission 24, which in combination drive motive power to a host engine. The disclosed technology is engaged with the host engine by means of its controller 1, which controls operation of the system, and its starter ring gear 5, which receives torque from the system as herein described. An electric starter motor controller 4 may be integrated into the system to sense and report various conditions of system components and control operation of the motor.

The electric starter motor 10 may be a AC induction, high output, brushless, variable speed, digital motor, capable of producing at least 25 hp and preferably up to at least 10,000 rpm. Further the motor may have a stator inside the rotor, and include temperature and speed monitoring capabilities. The motor provides rotational power through its output shaft (pinion gear) 11, secured within the bore of a motor gear 12.

The pneumatically actuated transmission 24 may be a gear-type transmission having a transmission housing 16, a piston 19, an extendable transmission shaft having an input shaft 15*a* and an output shaft 15*b*, a receiving gear 13 and an output gear 22. The transmission shaft traverses through aligned bores of the transmission housing and a central bore of the piston 19 housed in the transmission housing 16.

The receiving gear 13 of the transmission is mated with the motor gear 12, wherein the gear ratio between the motor gear and the receiving gear is between 2.0:1 to 3.0:1. Secured within the bore of the receiving gear 13 is a torque limiter 14 to which the transmission input shaft 15*a* is rotatably coupled. The output shaft 15*b* is affixed to the output gear 22, available for mating engagement with the host engine starter ring gear 5 to drive motive power to the host engine. By this configuration, torque generated by the motor gear 12 is transferred to and increased by the receiving gear 13 and, subject to the override of the torque limiter (thereby controlling the maximum RPM of the starter ring gear), further to the extendable transmission shaft 15*a*, 15*b*, the output gear 22 and when engaged the starter ring gear 5 of the host engine.

The input shaft 15*a* and the output shaft 15*b* of the extendable transmission shaft rotate together to transmit motive power to the output gear 22, wherein the output shaft 15*b* is affixed to the piston 19 such that it extends from the input shaft by means of movement of the piston 19, as hereinafter described. The piston 19 may rotate with the output shaft 15*b*, or the output shaft 15*b* may be affixed thereto by means of a bearing ring or any other coupling which allows the output shaft to rotate with the input shaft, while maintaining the piston in a rotationally stationary position. A one-direction clutch, such as a one-way, lentil-type clutch 21 or similar mechanism, may be provided within the piston 19, to serve as means for engagement of the input and output shafts of the extendable transmission shaft, to ensure that the host engine starter ring gear 5 does not transmit torque back through the transmission output shaft 15*b* to the transmission input shaft 15*a* (and thereby the receiving gear 13, the motor gear 12, and the motor output shaft 11).

The transmission housing 23 includes an entry port 17 which receives pressurized gas from a pneumatic solenoid valve 2, controlled by the host engine controller 1. When receiving pressurized gas from the solenoid valve, the gas pressure pushes the piston 19, and therefore the transmission output shaft 15*b* and its affixed output gear 22, into an engaged position (as shown in FIG. 1), in which position the output gear 22 is mated with the host engine ring gear 5. In this position, gas flows out an exit port 18 of the transmission housing 23, to a pressure sensor 3. When the pressure sensor senses such gas pressure from the transmission housing exit port, it sends a signal to the electric starter motor controller 4 to start the electric starter motor 10.

Figure 2:
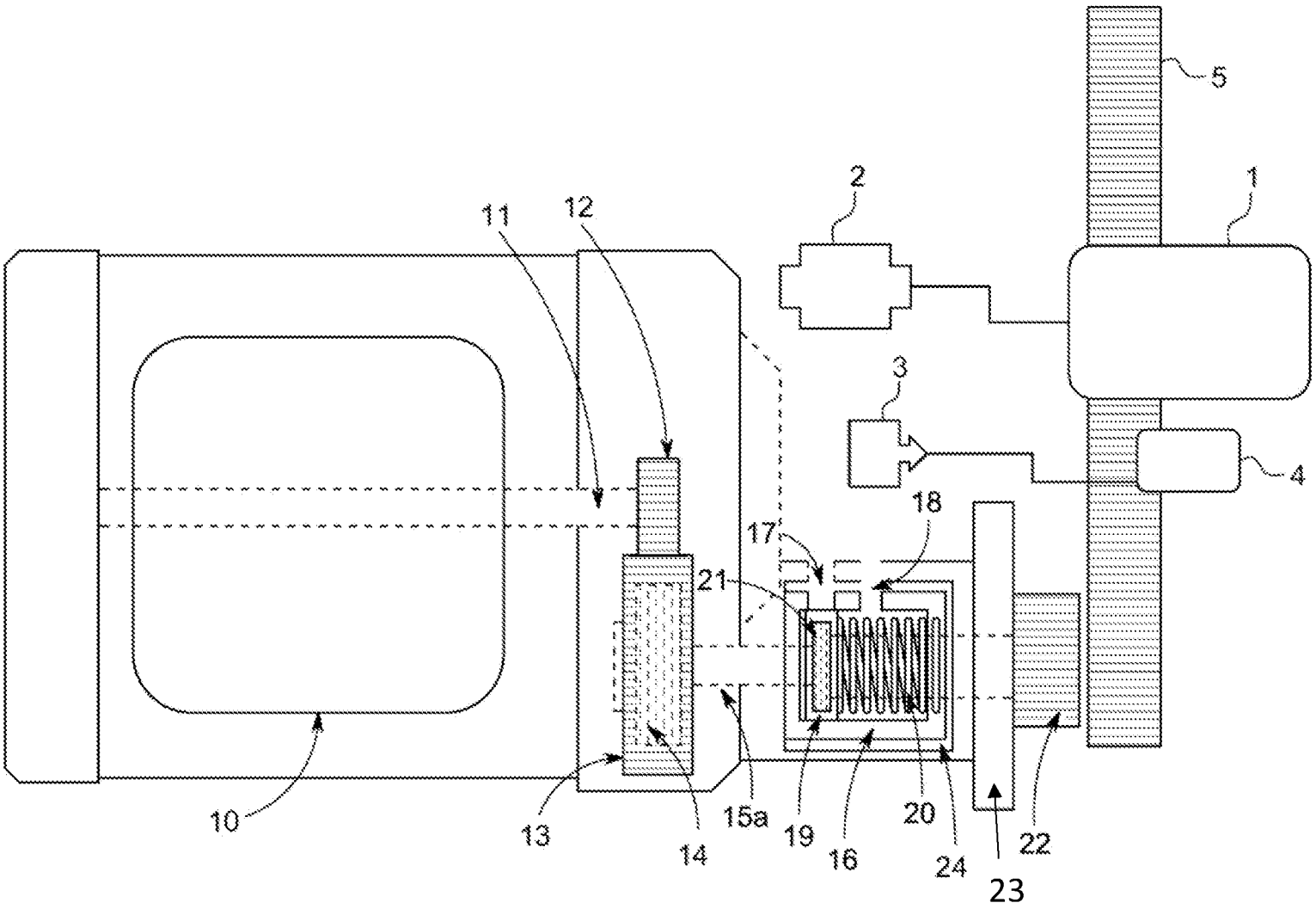
FIG. 2 shows the embodiment of FIG. 1 in the disengaged position.

The pneumatic solenoid valve 2 will continue to supply pressurized gas through the entry port 17 of the transmission housing 16 until the host engine reaches a certain predetermined RPM sufficient to facilitate internal combustion and complete its start and run cycle. When this condition is sensed by the host engine, the controller 1 will send a signal to the solenoid valve 2 to stop supplying pressurized gas to the transmission housing 16, and the piston 19 (and the affixed transmission output shaft 15*b* and output gear 22) will return to a disengaged position by means of a spring 20 (as shown in FIG. 2). In this configuration, the transmission output gear is not in mating engagement with the host engine ring gear 5. Further, since no gas is flowing out of exit port 18, the pressure sensor 3 will sense the condition and send a signal to the electric starter motor controller 4 to stop the electric starter motor 10.

A shaft mount or flange bearing 23 may be provided to secure the transmission 24 to the host engine, the shaft mount 23 having an aperture to receive the output shaft 15*b*, without impeding rotation and linear movement of the output shaft as herein described.

The gears herein described are spur gears, which in combination work to achieve the desired output power and torque, and further enable the system to be more compact. O-rings may be positioned about the piston 19 and in bores of the transmission housing 16 to secure the extendable transmission shaft without creating friction as it rotates, to control movement of the piston within the transmission housing, and to eliminate any leakage of pressurized gas.

As hereinabove provided, the electric starter motor controller 4 controls at least the operation of the electric starter motor 10. Further, this controller may be programmed and coupled with various external data inputs and sensors, to monitor conditions such as starter motor condition, transmission engagement status, electric motor temperature, electric motor supply voltage/amperage, electric motor speed/over-speed (and history), electric motor output/torque, starting cycle status, starting cycle duration, starting cycle start/stop (and history), start cycle count over time (and history), and starting cycle safety limits. The controller may be coupled with a user interface, which provides a visual display (graphic, text, or in combination) to indicate the status of the various components of the system of the disclosed technology, may supply messages based upon information available to or processed by the digital controller, alarms (including audible alarms) in the event any conditions exceed a pre-set value, and other selectable data.

Electric energy storage and recharging systems, such as one or more batteries, alone or as part of a battery charging management system (BMS), may be provided with the system of the disclosed technology to provide electricity to the starter motor as well as any digital controller and components thereof. Depending on specific application objectives, battery types used to power the system and/or its components may include alkaline, nickel metal hydride (NIMH), lead acid, and lithium ion batteries, as well as other suitable batteries. Battery charging and recharging options may incorporate one or more of the following known methodologies: auxiliary genset, site solar array, site utility power, and engine driven alternator/generator.

Figure 3:
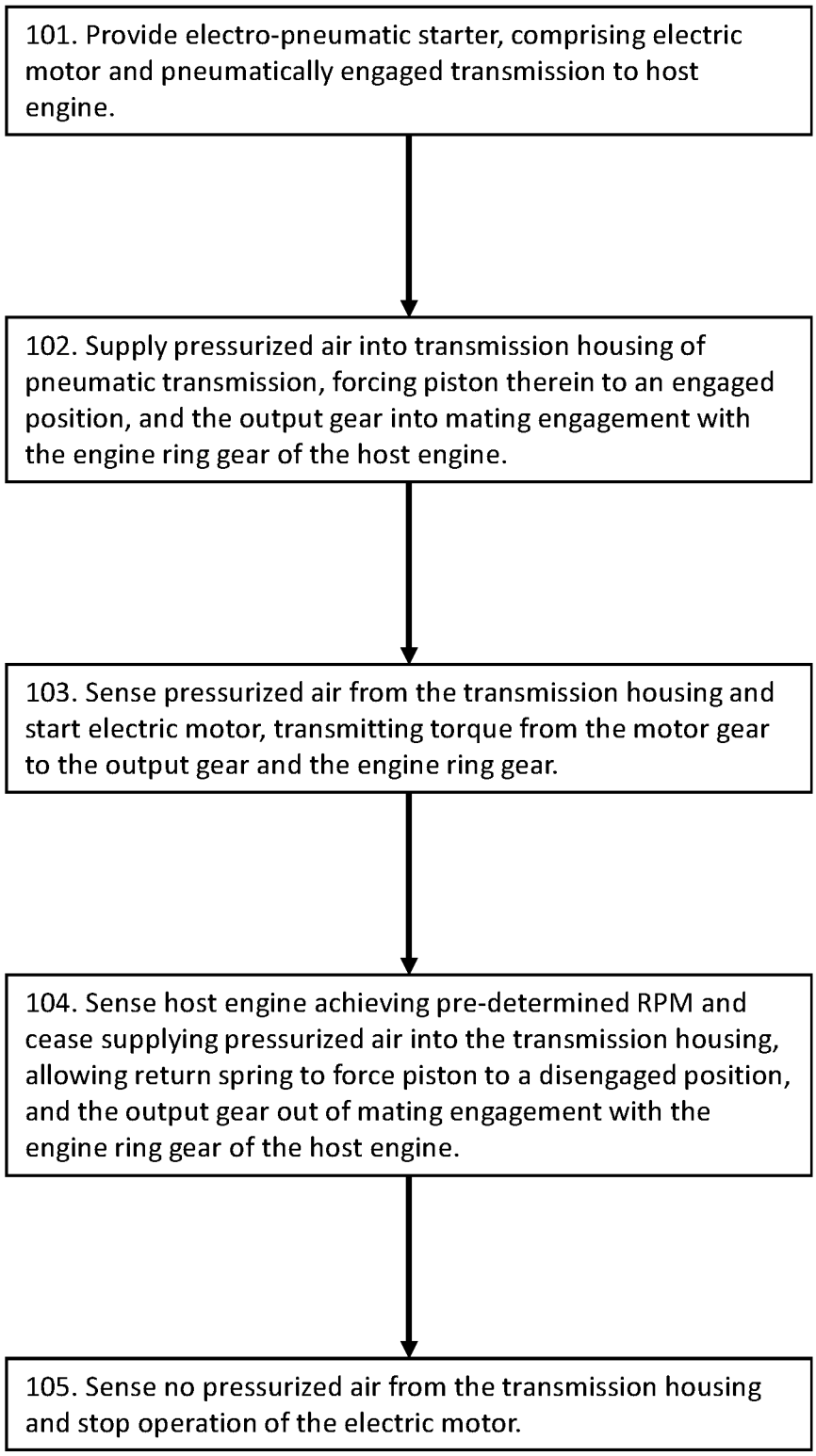
FIG. 3 is a flow-chart of a method of the disclosed technology.

As generally shown in FIG. 3, the disclosed technology further includes a method for starting a natural gas powered, reciprocating internal combustion engine in oil and gas industrial applications, at 101 providing an electro-pneumatic starter, including an electric motor and a pneumatically engaged transmission to the host engine, as hereinabove described. In operation, pressurized gas is supplied in the entry port of the transmission housing of the pneumatic transmission, forcing the spring loaded piston to translate into an engaged position, thereby translating the transmission output shaft and the output gear such that the gear is in mating engagement with the starter ring gear of the host engine, at 102. Upon sensing pressurized gas flowing from the exit port of the transmission housing, the pressure sensor sends a signal indicating that pressure is sensed, thereby revealing that the system is engaged with the host engine, and based upon such signal the motor commences operation, at 103.

By means of the motor and the pneumatic transmission, torque from the output shaft and gear of the motor is transmitted and increased by means of the receiving gear and the transmission shaft, and further transmitted to the output gear and the host engine ring gear. Once the ring gear of the host engine is operating at a sufficient RPM, and no longer needs torque from the starter motor, the pressurized air ceases to flow into the transmission housing, allowing the piston to return to the disengaged state (encouraged by the spring), and disengaging the output gear from the ring gear of the host engine, at 104. Upon sensing the lack of pressurized gas flowing from the exit port of the transmission housing, the pressure sensor sends a signal indicating that no pressure is sensed, and based upon such signal the motor ceases operation, at 105.

The invention claimed is:

1. An electro-pneumatic starter for use with a natural gas powered, reciprocating internal combustion engine in oil and gas industrial applications, the starter comprising:

a. a brushless, digital electric motor, the motor having an output shaft which drives a motor spur gear; and b. a pneumatically actuated transmission comprising:

i. a transmission input shaft affixed to a torque limiter within a receiving spur gear, the receiving spur gear being in mating engagement with the motor spur gear such that in operation rotation of the output shaft by the electric motor translates into rotation of the motor spur gear, which drives the receiving gear and the transmission input shaft, subject to limitations of torque as imposed by the torque limiter;

ii. a transmission output shaft extendably coupled at one end with the transmission input shaft such that rotation of the input shaft is directly translated to rotation of the transmission output shaft, and affixed at the other end to an output gear capable of mating engagement with a ring gear of the engine, wherein the transmission input shaft and the transmission output shaft are coupled by means of a one-direction clutch such that the engine ring gear does not transmit torque back through the transmission output shaft to the transmission input shaft;

iii. a transmission housing supporting a spring-loaded piston, the piston being coupled with the transmission output shaft such that movement of the piston within the transmission housing translates directly into extension or retraction of the transmission output shaft and the affixed output gear relative to the transmission input shaft;

iv. wherein the transmission housing includes an entry port which receives pressurized gas from a pneumatic solenoid valve, forcing the piston to move within the transmission housing into an engaged position, exposing an exit port of the transmission housing; and v. a pressure sensor which senses the presence or absence of pressurized air at or from the exit port, and upon sensing the presence of pressurized air sends a signal to an electric motor controller to start the electric motor.

2. The electro-pneumatic starter of claim 1, wherein the electric motor is an alternating current, variable speed induction motor.

3. The electro-pneumatic starter of claim 1, wherein a torque limiter is secured within the receiving spur gear and the transmission input shaft, to limit the torque applied to the transmission input shaft.

4. The electro-pneumatic starter of claim 1, wherein the one-direction clutch is a dentil-type clutch.

5. The electro-pneumatic starter of claim 1, wherein the pneumatic solenoid valve continues to supply pressurized air through the entry port of the transmission housing until the engine reaches a certain pre-determined RPM sufficient to facilitate internal combustion and complete its start and run cycle, and when such condition is sensed by the engine, the solenoid valve stops supplying pressurized gas to the transmission housing, the piston and the transmission output shaft and output gear return to a disengaged position by means of a spring of the spring loaded piston, thereby withdrawing the output gear from mating engagement with the host engine ring gear.

6. The electro-pneumatic starter of claim 5, wherein when the pressure sensor senses that no gas is flowing out of the exit port, the sensor sends a signal to the electric starter motor controller to stop the electric motor.

7. A method for starting a natural gas powered, reciprocating internal combustion engine, the method comprising:

a. providing an electro-pneumatic starter, the electro-pneumatic starter comprising:
   i. an electric motor having an output shaft secured to a motor gear; and
   ii. a pneumatically actuated transmission comprising a transmission housing, a piston, an extendable transmission shaft, a receiving gear, and an output gear,
   wherein the extendable transmission shaft is coupled with the piston housed in the transmission housing, with a receiving gear at one end of the extendable transmission shaft, and an output gear at the opposing end of the extendable transmission shaft, the output gear being available for mating engagement with a starter ring gear of the engine;
   wherein the receiving gear is mated with the motor gear such that torque from the receiving gear is transferred to the extendable transmission shaft and the output gear; and
   wherein the transmission housing includes an entry port which receives pressurized gas from a pneumatic solenoid valve, pushing the piston into an engaged position, thereby translating an output shaft of the extendable transmission shaft and the output gear into mating engagement with the starter ring gear of the host engine, which pressurized gas flows out an exit port of the transmission housing and to a pressure sensor, which when sensing such pressure sends a signal to an electric motor controller to start the electric motor;

b. providing pressurized gas to the entry port of the transmission housing, thereby forcing the piston into the engaged position, resulting in translation of the output shaft of the extendable transmission shaft and the affixed output gear into mating engagement with the starter ring of the engine; and c. sensing pressurized gas from the exit port of the transmission housing by means of the pressure sensor, and sending a signal to the electric motor to produce rotation on the output shaft and the motor gear, thereby creating torque which is provided to the receiving gear, the extendable transmission shaft, the output gear and the starter ring of the engine.

8. The method of claim 7, wherein the electric motor is a brushless, digital electric motor capable of producing at least 25 horsepower and up to at least 10,000 revolutions per minute.

9. The method of claim 7, wherein an input shaft of the extendable transmission shaft is affixed to a torque limiter within the receiving gear.

10. The method of claim 9, wherein the output shaft is extendably coupled at one end with the transmission input shaft such that rotation of the input shaft is directly translated to rotation of the output shaft, and wherein the input shaft and the transmission output shaft are coupled by means of a one-direction clutch such that the engine ring gear does not transmit torque back through the output shaft to the input shaft.

11. The method of claim 10, wherein the one-direction clutch is a lentil-type clutch.

12. The method of claim 7, wherein the pressurized gas is controlled by a pneumatic solenoid valve actuated by a signal from a host engine controller.

13. The method of claim 12, wherein pressurized gas is provided to the entry port of the transmission housing until the host engine reaches a certain pre-determined RPM sufficient to facilitate internal combustion and complete its start and run cycle, at which time no additional pressurized gas is provided to the transmission housing, the piston returns to the disengaged position, translating with it the output shaft of the extendable transmission shaft and the output gear disengages from the starter ring of the host engine.

14. The method of claim 13, wherein when the pressure sensor senses that no gas is flowing out of the exit port, the sensor sends a signal to the electric starter motor controller to stop the electric motor.

* * * * *